US011345372B1

(12) United States Patent
Stern et al.

(10) Patent No.: US 11,345,372 B1
(45) Date of Patent: May 31, 2022

(54) LIGHTWEIGHT YOKE FOR RAILWAY COUPLING

(71) Applicant: Pennsy Corporation, West Chester, PA (US)

(72) Inventors: Aaron Stern, West Chester, PA (US); Zachary Ryan Brook, Leola, PA (US); Manuel Tavares, Doylestown, PA (US); Wayne H. Murphy, Pottstown, PA (US); Perry Levitt, West Chester, PA (US); Michael J. Schmidt, Norristown, PA (US)

(73) Assignee: Pennsy Corporation, West Chester, PA (US)

( * ) Notice: Subject to any disclaimer, the term of this patent is extended or adjusted under 35 U.S.C. 154(b) by 294 days.

(21) Appl. No.: 16/379,783

(22) Filed: Apr. 9, 2019

Related U.S. Application Data

(60) Continuation-in-part of application No. 16/378,447, filed on Apr. 8, 2019, which is a division of
(Continued)

(51) Int. Cl.
*B61F 5/52* (2006.01)
*C22C 37/10* (2006.01)
*C22C 37/08* (2006.01)

(52) U.S. Cl.
CPC ..... *B61F 5/52* (2013.01); *C22C 37/08* (2013.01); *C22C 37/10* (2013.01)

(58) Field of Classification Search
CPC ... B61G 9/00; B61G 7/10; B61G 9/22; B61G 9/24; B61G 9/06; B61G 9/04; B61F 5/52; C22C 37/08; C22C 37/10
See application file for complete search history.

(56) References Cited

U.S. PATENT DOCUMENTS 2,088,135 A 7/1937 Johnson et al.
2,186,008 A 1/1940 Everett
(Continued)

FOREIGN PATENT DOCUMENTS

EP 0232042 8/1987
WO 2006072663 A2 7/2006

OTHER PUBLICATIONS

Brandenberg, Kristin, "Successfully Machining Austempered Ductile Iron (ADI)", Applied Process Inc. Technologies Div.—Livonia, Michigan, USA, Oct. 2001.
(Continued)

*Primary Examiner* — Mark T Le
(74) *Attorney, Agent, or Firm* — Bonini IP Law, LLC; Frank J. Bonini, Jr.

(57) ABSTRACT

Lightweight yokes are provided. According to some embodiments, the basic overall appearance of the yoke may be maintained, but the actual material of which it is constructed is changed. According to other embodiments, the yoke is provided with an improved lightweight construction, and, yet other embodiments the yoke may be provided with an improved construction and formed from a preferred material. Yokes may be constructed from cast austempered ductile iron; whereas cast iron has a density, 0.26 lbs/in^3, which is approximately 8% less than steel, 0.283 lbs/in^3, thereby allowing for a reduction in weight over steel. A suitable austempering process is used to produce the austempered metal yoke. Yokes have improved configurations which may require less metal to produce the yoke. Both, the lightweight material and improvements in configuration of the yoke structure may combine to provide a lighter weight yoke.

28 Claims, 7 Drawing Sheets

Related U.S. Application Data application No. 14/930,145, filed on Nov. 2, 2015, now Pat. No. 10,252,733, which is a continuation-in-part of application No. 13/678,087, filed on Nov. 15, 2012, now abandoned.

(56) References Cited

U.S. PATENT DOCUMENTS

| | | | | |
|---|---|---|---|---|
| 2,930,329 | A | 3/1960 | Busch | |
| 3,000,330 | A | 9/1961 | Shafer | |
| 3,754,514 | A | 8/1973 | Peterson | |
| 4,024,958 | A | 5/1977 | Kaufhold | |
| 4,081,082 | A | 3/1978 | Scherrer et al. | |
| 4,424,750 | A | 1/1984 | Tilly et al. | |
| 4,537,304 | A | 8/1985 | Kaim et al. | |
| 4,737,199 | A | 4/1988 | Kovacs | |
| 5,096,076 | A | 3/1992 | Elliott et al. | |
| 5,320,229 | A | 6/1994 | Mautino et al. | |
| 5,410,968 | A | 5/1995 | Hawthorne et al. | |
| 5,481,986 | A | 1/1996 | Spencer et al. | |
| 5,511,676 | A | 4/1996 | Holmes | |
| 5,522,949 | A * | 6/1996 | Widmer | C21D 1/20 148/321 |
| 5,878,897 | A | 3/1999 | Lazzaro et al. | |
| 5,900,082 | A | 5/1999 | Hewitt | |
| 6,102,983 | A * | 8/2000 | Skaland | C21C 1/10 75/568 |
| 6,173,655 | B1 | 1/2001 | Hawthorne | |
| 6,796,448 | B1 * | 9/2004 | Wilt | B61G 7/10 213/40 R |
| 7,926,672 | B2 | 4/2011 | Ely | |
| 8,607,998 | B2 | 12/2013 | Mcmillen et al. | |
| 9,822,433 | B2 * | 11/2017 | Mito | C22C 33/08 |
| 10,252,733 | B1 | 4/2019 | Tavares et al. | |
| 2010/0294452 | A1 | 11/2010 | Berthelet | |
| 2012/0248053 | A1 | 10/2012 | Mcmillen et al. | |
| 2014/0360965 | A1 * | 12/2014 | Levitt | B61G 9/20 213/67 R |
| 2016/0138139 | A1 * | 5/2016 | Fujimoto | C22C 38/005 75/342 |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering a.

Luis Magalhães, Jorge Seabra, "Teeth Surface Failures in Austempered Ductile Iron (ADI) Gears", Gears and Transmission Workshop, Paper No. XIII, p. 269-286, Faculdade de Engen.

Stokes B. et al., "Effects of Carbides on Fatigue Characteristics of Austempered Ductile Iron", Metallurgical and Materials Transactions A, 36 (2005) 977-988.

Bubenko et al., "Fatigue Crack Propagation through Austempered Ductile Iron Microstructure", Materials Engineering, vol. 17, 2010, No. 3, p. 15-20.

Bubenko et al.,"Fatigue Crack Propagation Within the Austempered Ductile Iron Microstructure", Acta Metallurgica Slovaca, vol. 17, 2011, No. 1, p. 18-25.

Dundar, Sacit, "Application of Austempered Ductile Iron to Rail Wheel Sets", Journal of Engineering Sciences 2003, 9 (3), p. 283-287.

International ADI and Simulation Conference, May 28-30, 1997.

Knuckles, Types E and F—Fatigue Test, AAR Manual of Standards and Recommended Practices Castings, 2009, [M-216] 1-2.

Keough J. R., et al.,"Continuing Developments in the Science and Application of Austempered Ductile Iron (ADI)", 2012.

AAR Manual of Standards and Recommended Practices Casting Details, Castings, Steel, Specification M-201, S [M-201] 41—S [M-201] 49.

AAR Manual of Standards and Recommended Practices Casting Details, S [M-211] 143—S [M-211] 149.

AAR Manual of Standards and Recommended Practices Casting Details, Coupling Systems, Specification M-215, S [M-215] 337—S [M-215] 342.

"The Six Standard ADI Grades Per ASTM A897/A897M-06", www.appliedprocess.com, Issued Nov. 4, 2008.

AAR Manual of Standards and Recommended Practices Casting Details,Truck Bolsters, Cast or Structural—Design and Testing, Specification M-202, S [M-202] 51—S [M-202] 64.

AAR Manual of Standards and Recommended Practices Casting Details, Truck Side Frames, Cast Steel—Design and Testing, Specification M-203, S [M-203] 65—S [M-203] 76.

AAR Manual of Standards and Recommended Practices Casting Details, Bolster Design Loads, Specification M-203A, S [M-203A] 77—S [M-203A] 82.

AAR Manual of Standards and Recommended Practices Trucks and Truck Details, Truck Performance for Rail Cars, Specification M-976, D [M-976] 31—D [M-976] 38.

"Ductile iron", Wikipedia, the free encyclopedia, http://en.wikipedia.org/wiki/Ductile_iron#Composition, p. 1-3.

Hayrynen, Kathy L., The Production of Austempered Ductile Iron (ADI), 2002 World Conference on ADI.

Aristizabal, Ricardo E., "Intercritical Heat Treatments in Ductile Iron and Steel", Materials Science and Engineering, Birmingham, Alabama, 2012.

FerroPem—Groupe—FerroAtlantica, Newsletter—Jan. 2012.

SAIFoundry, "Austempered ductile iron production properties", http://www.slideshare.net/SAIFoundry/austempered-ductile-iron-production-properties-applications#,Mar. 19, 2012.

SY40AE Yoke Publication.

Y45AE Yoke Publication.

* cited by examiner

LIGHTWEIGHT YOKE FOR RAILWAY COUPLING

CROSS-REFERENCE TO RELATED APPLICATIONS

This application is a continuation-in-part of, and claims priority to, U.S. patent application Ser. No. 16/378,447, filed on Apr. 8, 2019, which claims priority to U.S. patent application Ser. No. 14/930,145, filed on Nov. 2, 2015, which claims priority to U.S. patent application Ser. No. 13/678,087, filed on Nov. 15, 2012, now abandoned, the complete contents of which applications are herein incorporated by reference.

BACKGROUND OF THE INVENTION

1. Field of the Invention

This invention relates in general to railcars and, more particularly, to railcar yokes for a coupler system.

2. Brief Description of the Related Art

Railcar couplers are disposed at each end of a railway car to enable joining one end of such railway car to an adjacently disposed end of another railway car. The engageable portion of each of these couplers is known in the railway art as a knuckle. For example, railway freight car coupler knuckles are taught in U.S. Pat. Nos. 4,024,958; 4,206,849; 4,605,133; and 5,582,307.

Typically, adjacent railway cars are joined by heavy shafts extending from each car, known as couplers, and, generally, each coupler is engaged with a yoke housing a shock-absorbing element referred to as the draft gear. The type-E coupler is the standard coupler for railway freight cars. The type-E coupler has standard specifications such that producers making a type-E coupler adhere to a standard specification, so that the standard railway car couplers are completely interchangeable, regardless of the manufacturer. In addition, adherence to a standard also enables couplers from any one manufacturer to be able to be readily joined to couplers from any other domestic manufacturer. The Association of American Railroads ("AAR") has adopted standards for railway couplers. The coupler must include specific geometry and dimensions that allow it to receive a knuckle, and the geometry must be such that the knuckle is allowed to freely operate when coupling and uncoupling railway cars. These dimensions and features of the coupler may be checked for compliance with AAR standards by using gauges, which are applied to the coupler to verify the coupler dimensions or parameters are within an allowable variation or tolerance range.

Couplers have a particular life, and in instances may fail. In many cases when a railcar coupler fails, a replacement coupler must be carried from the locomotive at least some of the length of the train, which may be up to 25, 50 or even 100 railroad cars in length. The repair of a failed coupler can be labor intensive, can sometimes take place in very inclement weather and can cause train delays.

The yoke is a generally elongated structure having two side sections that extend from and join with a tail portion. The side sections are also known and referred to as "straps". The side sections or straps are joined at the opposite end by a head portion where the yoke is joined to the coupler with a securing component, such as a key or pin. The yoke generally has a pocket formed by the straps and a rear wall, and a draft gear is positioned between the straps of the yoke, and between the tail portion and the head portion. The best-known yokes are the E-type and F-type. The E-type yoke is governed by AAR standards that include the AAR S-143 Standard, SY 40AE, Y40 or YS93AE, for a 245/8 inch gear pocket, although there are some tolerances that the pocket may have, as permitted by the standards. A typical E-type yoke has straps that are 5 inches. The F-type yoke is governed by the S-149 standard and the Y45 standard. Although there are other differences between E-type and F-type yokes, a primary difference is the design and orientation of the pin or key used to join the coupler to the yoke.

Typical yokes contain apertures in the yoke head portion, which also may be known as the key slots or pin bores by which a coupler is joined to the yoke with the installation of a key or pin through the slot or bore to connect the yoke and coupler. Adjacent railcars, when coupled together and in motion, place tension on the yoke and compressive forces are transferred to bearing surfaces at opposed ends of the yoke where the draft gear is housed.

Adjacent freight cars are separated in accordance with standard specifications which includes an allowance for a specified yoke length. In accordance with applicable AAR standards, typically, E-type and F-type yokes, respectively, may have a length of 41⅛" or 37½".

SUMMARY OF THE INVENTION

The present invention provides a railcar yoke for use in a coupler system.

A railcar coupler typically includes a coupler head portion extending from a shank portion. A yoke is designed to mount onto the sill of a railway vehicle and connect to the coupler shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler.

Another object of the invention is to provide a lightweight yoke for use with railway couplers.

According to a preferred embodiment, a lightweight yoke is provided and is constructed from a material that is stronger than grade E cast steel. Is a further object to accomplish the above objects by providing a yoke that is constructed from a material that is at least as strong, or even stronger, than grade E cast steel but which is lighter in weight than grade E cast steel.

According to embodiments of the present invention, the yoke is stronger and more fatigue resistant than prior yokes of the same weight. According to one preferred embodiment, the yoke is lighter in weight than prior yokes (such as those constructed from grade E cast steel) and is both stronger and more fatigue resistant. According to a second preferred embodiment, the yoke possesses or exceeds the strength and fatigue resistance of prior yokes (such as those constructed from grade E cast steel) but is lighter in weight. According to a third preferred embodiment, the yoke is constructed having the same weight as prior yokes (such as those constructed from grade E cast steel), but with improved strength and fatigue resistance.

It is another object of the invention to accomplish the above objects by providing a yoke with an interior and/or exterior geometry that has one or more of coring (i.e., cavities) and ribs, or combinations thereof. Another object of the invention is to construct the yoke so that the maximum wall thickness preferably is about 1.25" or less, and more preferably about 1.15" or less, and with the yoke being constructed from a material that is lighter and of similar or greater strength than grade E cast steel. Preferred thicknesses for the yoke walls, according to some embodiments, are from about 0.25 inch to about 1.25 inches. According to preferred embodiments, the maximum wall thickness is defined as the maximum diameter of a sphere that can fit within the thickness of the part, such as, a wall of the yoke.

It is an object of the invention to provide a yoke that is constructed from an austempered metal. In a preferred embodiment, the austempered metal is austempered ductile iron (ADI). In another preferred embodiment the austempered metal is austempered steel, such as austempered alloy steel, and, according to other embodiments the coupler and yoke may be constructed from an austempered metal alloy.

The austempered ductile iron (ADI) yoke is produced by a suitable austempering process. For example, austempering of ductile iron may be accomplished by heat-treating cast ductile iron to which specific amounts of nickel, molybdenum, manganese or copper, or combinations thereof have been added to improve hardenability; the quantities of the elements needed to produce the ADI from ductile iron are related to the coupler configurations and, for example, may depend on the thickest cross-sectional area of the coupler or the yoke. Austempered steel and other austempered metals and austempered metal alloys, may be produced by any suitable austempering process. The yoke may be produced by casting, including sand casting or investment casting, or other suitable method. The casting of the yoke or formed yoke is austenitized by applying an austempering process on the yoke. For example, the yoke may be formed from a casting of ductile iron, and the ductile iron yoke casting austempered.

According to one embodiment, it is another object of the invention to provide an improved lightweight yoke that is lighter in weight than existing current yokes, but without additional coring or modifications to the interior of the yoke geometry, by constructing a yoke from an ADI having a density of about 0.26 lbs/in^3, which is less than that of grade E cast steel, 0.283 lbs/in^3. According to one embodiment, a casting of the same shape will be lighter and stronger when constructed from ADI versus grade E cast steel. According to a preferred embodiment, there is a weight reduction of about 8% using the ADI as the preferred material for the yoke versus using grade E cast steel.

Another benefit of the present invention is to provide a yoke, and process for producing the yoke that provides economic benefits of conservation of materials, without sacrificing strength. For example, the utilization of a preferred ADI material improves handling efficiencies (as iron is easier to pour than steel), and improves material usage, as the ADI material increases in volume, slightly, as the metal yoke casting cools compared to steel which shrinks. Accordingly, embodiments of the present invention provide a more efficient use of the materials, meaning less metal may be used to make the same final shape (for a yoke having substantially the same or greater strength as if a greater amount of metal were used), as a way of reducing the yoke weight.

In another preferred embodiment, the austempered metal is austempered steel.

Austempered steel is produced by a suitable austempering process. For example, austempering of steel may be accomplished by heat-treating cast steel to which specific amounts of chromium, magnesium, manganese, nickel, molybdenum, or copper, or combinations thereof have been added to improve hardenability; the quantities of the elements needed to produce the austempered steel from the cast alloy steel are related to the yoke configurations and, for example, may depend on the thickest cross-sectional area of the yoke.

According to another embodiment, a lighter weight yoke is constructed by selectively coring out material in thick load bearing areas (or alternatively otherwise reducing material in these areas when cores are not used) to provide an alternate interior and/or exterior geometry for the yoke so maximum wall thickness for the yoke is preferably about 1.15" or less, and more preferably about 0.75" or less.

According to preferred embodiments, the yoke may be reduced in thickness in a given zone or area, such as a wall and the strength to weight ratio may remain the same as or greater than prior yokes having thicker walls, and even being heavier in weight. According to some preferred embodiments, the maximum wall thickness of the yoke may be about 1.15 inches, and, according to some embodiments, the yoke may have walls with thicknesses about 0.75" or less. According to some preferred embodiments, the yoke wall thickness may be in a range from about 0.25 inches to about 1.25 inches. The present yoke, when used in a coupling assembly, also may improve payload to weight ratios, as a lightweight yoke may allow for more weight to be cargo or other payload, especially where a locomotive is pulling a great number of cars that have lightweight yokes.

According to some preferred embodiments, the weight reduction may be made at the back, nose end sections or straps of the yoke, and may be accomplished with coring, such as, for example, exterior coring. Embodiments may be produced with reduced weight by providing exterior coring on the side and back sections of the keyslot walls, straps or rear or nose sections.

According to embodiments, the yoke may have one or more zones of coring and ribs, or apertures, bores and/or divots, where the yoke has areas or walls of a maximum cross-sectional thickness and other areas that are less than the maximum cross-sectional thickness.

The arrangement of coring (or cavities), ribs and wall thickness, may be provided to produce a yoke that is lighter in weight, but possesses sufficient strength, including meeting or exceeding railroad standards, such as AAR standards for yokes. In addition, the embodiments of the yoke may be produced from an austempered metal, such as, for example, austempered ductile iron, which is lighter in weight than grade E cast steel, but provides equal or greater strength, to provide a lightweight yoke that preferably is constructed from ADI and has an arrangement of ribs and/or coring (i.e., cavities).

According to another embodiment, a yoke may be provided having one or more zones of residual compressive stresses. According to one embodiment, a zone, or zones, of residual compressive stresses may be created on the entire inside and outside surface of any of the above embodiments of the lightweight yoke, while according to alternate embodiments, zones of residual compressive stresses may be created only in areas that show high tensile stress when the part is used, or combinations thereof in the areas that show high tensile stresses. For example, according to a preferred embodiment, a yoke is provided with zones of residual compressive stresses in the main areas that exhibit high tensile stress during use. According to some preferred embodiments, the yoke is configured having zones of residual compressive stresses which, according to preferred embodiments, may be in the location of the key slot, the side walls transitions in the front and back and the back tail section, or combinations of these locations.

According to one embodiment, a preferred method for creating residual compressive stresses is by shot peening. Shot peening involves impacting the surface with small media projected at high speeds at the desired surfaces. According to embodiments of the invention, an engineered surface is provided, such as, for example, by subjecting the surface to a treatment process, such as, for example, shot peening, in order to provide the yoke with an improved ability to counteract tensile stresses that are applied during use that may otherwise tend to cause crack initiation. The provisioning of the residual compressive stresses on the yoke, such as, for example, using the shot peening procedure to impart impacts on the surfaces of the yoke at one or more desired locations, increases fatigue life and performance without the need to increase the overall strength of materials or of the part.

The lightweight yokes according to the invention may be used with standard knuckles or lightweight knuckles, including, such as, for example, the lightweight knuckles disclosed in our co-pending U.S. patent application Ser. Nos. 13/378,021 and 13/842,229, for a lightweight fatigue resistant knuckle, the complete contents of which are herein incorporated by reference.

According to some implementations, the lightweight yokes may be used together with lightweight couplers, such as, for example, lightweight couplers disclosed in our co-pending U.S. patent application Ser. No. 13/678,203, the complete contents of which are herein incorporated by reference. Further a lightweight coupler knuckle may be used with one or more of the lightweight yoke and lightweight coupler to provide a lightweight coupling system.

Moreover, while specific advantages have been enumerated above, various embodiments may include all, some or none of the enumerated advantages.

DETAILED DESCRIPTION OF THE INVENTION

The present invention provides improved yokes which have improved strength and fatigue life. One way in which embodiments of the invention accomplish this is by providing coring (i.e., cavities) that may include interior coring, external coring, or both. The coring referred to may be cavities formed by traditional methods (where cores are used and placed in a mold) or cavities formed using other methods for producing the yoke or coupler). Another way in which embodiments of the invention accomplish this is by constructing the yoke from a material that is stronger than the grade E cast steel currently used. A further way in which embodiments of the invention accomplish this is by utilizing a material to construct the yoke that is stronger and lighter than the grade E cast steel currently used, while other embodiments provide a lightweight yoke by providing a unique geometry and using a material that is lighter than the current cast steel and/or stronger than the current cast steel. The embodiments also may include ribs provided for strengthening areas or zones of the yoke, which, according to preferred embodiments, may be done in conjunction with coring (e.g., forming of cavities).

Figure 1:
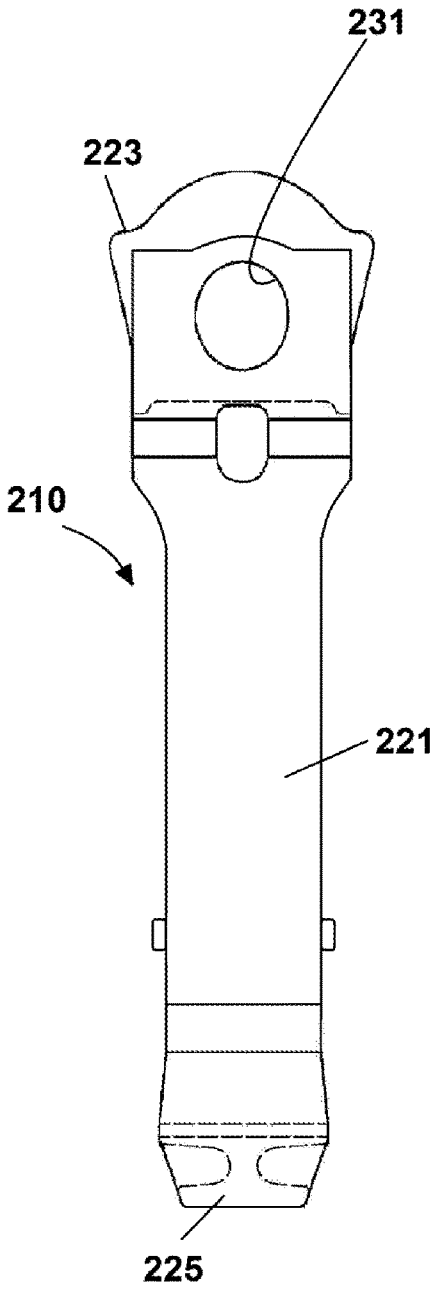
FIG. 1 is a top plan view of a yoke for a railway coupling system, showing a yoke having a prior type Type F configuration shape, but being constructed according to the invention as a lightweight yoke.
Figure 2:
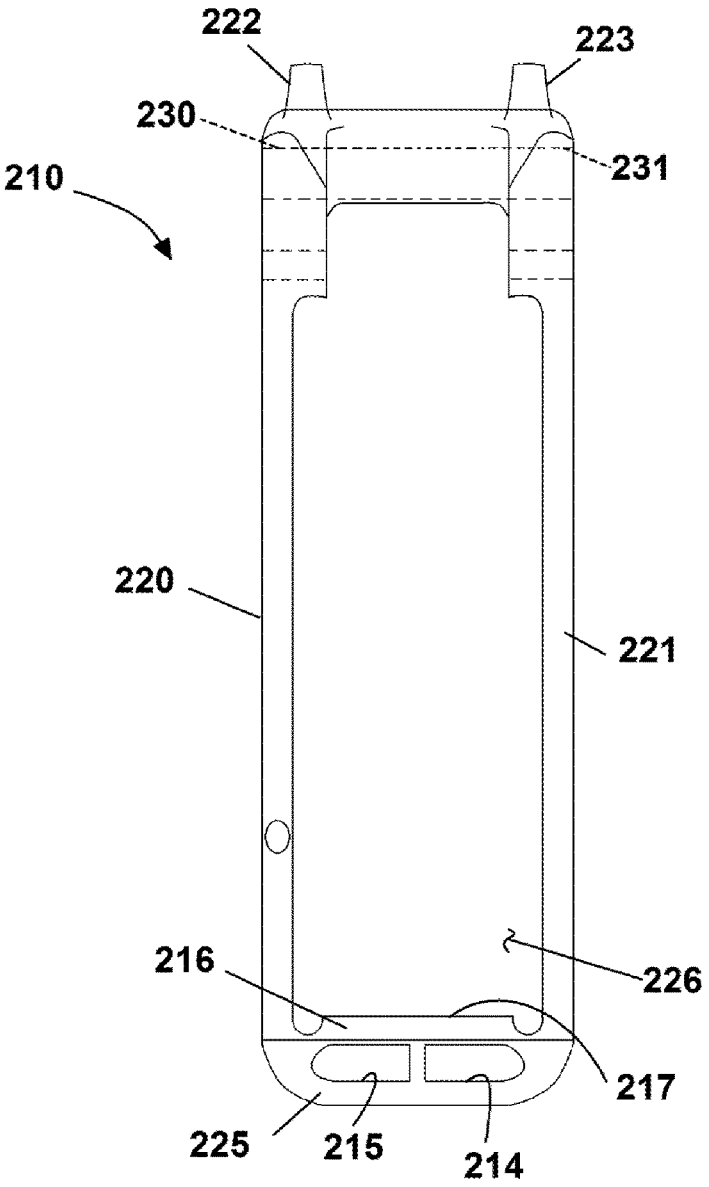
FIG. 2 is a side elevation view of the yoke of FIG. 1.
Figure 4:
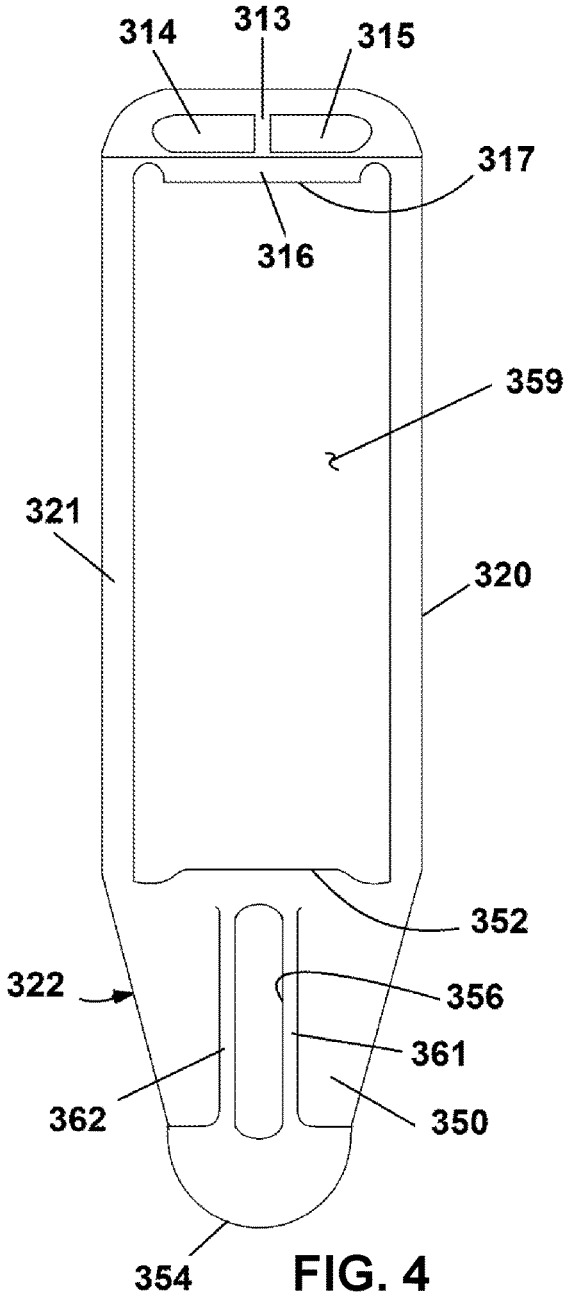
FIG. 4 is a side elevation view of the yoke of FIG. 3.
Figure 6:
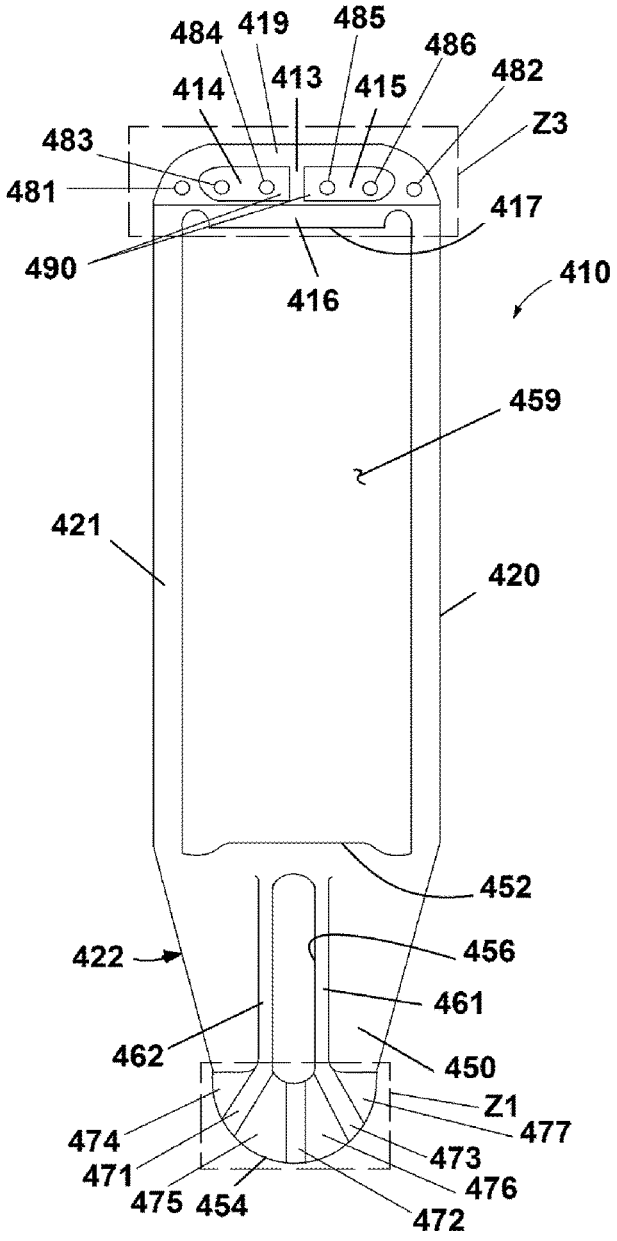
FIG. 6 is a side elevation view of the yoke of FIG. 5.
Figure 5:
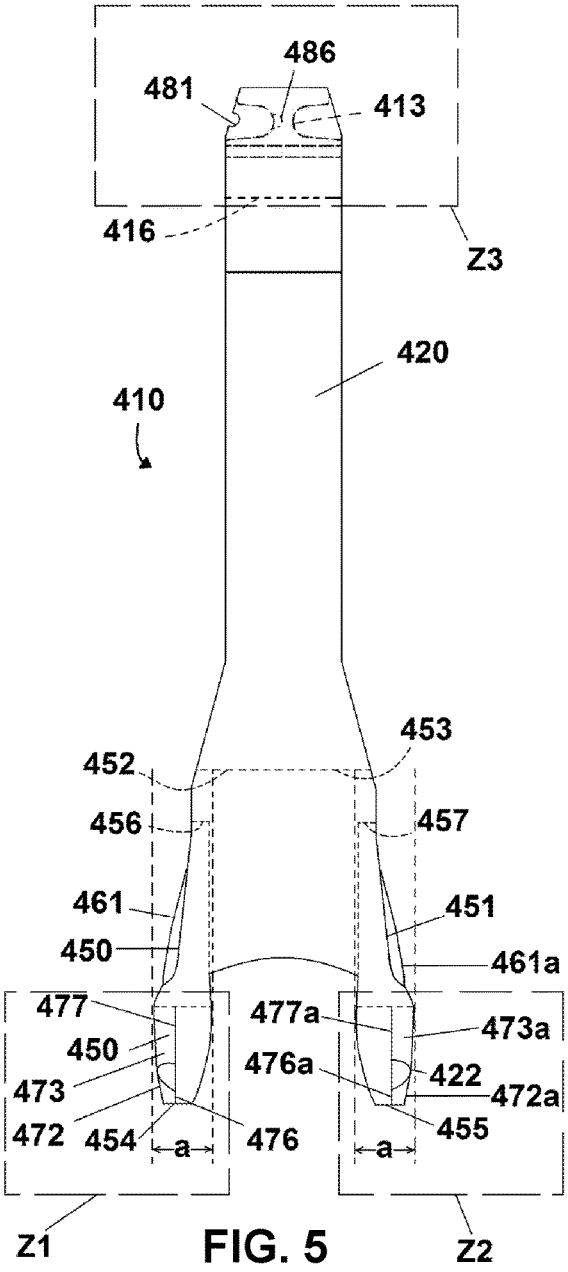
FIG. 5 is a top plan view of an alternate yoke for a railway coupling system, showing a yoke constructed according to the invention as a lightweight yoke and having an alternate configuration.

Referring to FIGS. 1-4, exemplary embodiments of a lightweight yoke 210, 310 are shown. The yokes 210, 310 are configured to resemble the prior yokes, and preferably are therefore, compatible with existing standard type couplers and knuckles to allow for use of the yokes 210, 310 in current railway coupling applications. The yokes 210, 310 are constructed from austempered metal, as discussed herein, and preferably may be constructed having suitable wall thicknesses to provide suitable strength to withstand force loads that a yoke would encounter during operations, including when in use on a railway vehicle, and including suitable strength properties to meet AAR standards. The yokes 210, 310, may be configured as a casting, and they may be installed on a center sill of a railway vehicle along with a coupler and a draft gear (not shown). FIGS. 5-6 illustrate preferred embodiments of a yoke 410 having alternate configurations with arrangements of ribs and dimples.

According to one embodiment, a type F coupler yoke 210 is provided having a top strap 220 and bottom strap 221. The top strap 220 is shown having a head portion 222, and the bottom strap 221 also has a head portion 223. A rear portion 225 connects the top strap 220 and bottom strap 221 to form a central pocket 226 within the yoke 210. The pocket 226 is shown open at the two sides between the top and bottom straps 220, 221. A first pin hole 230 is provided extending through the head portion 222 of the top strap 220 and a second pin hole 231 is provided extending through the head portion 223 of the bottom strap 221. The pin holes 230, 231 are configured to receive a pin (not shown), and a draft gear (not shown) is provided and seated within the pocket 226. The yoke 210 may be installed by securing a coupler shank (not shown) to the yoke 210 with a pin (not shown) that is installed in the pin holes 230, 231. The yoke 210 preferably has lightener pockets 214, 215 at the rear portion 225. The yoke 210 has a draft gear seat 216 with a planar surface 217.

Figure 3:
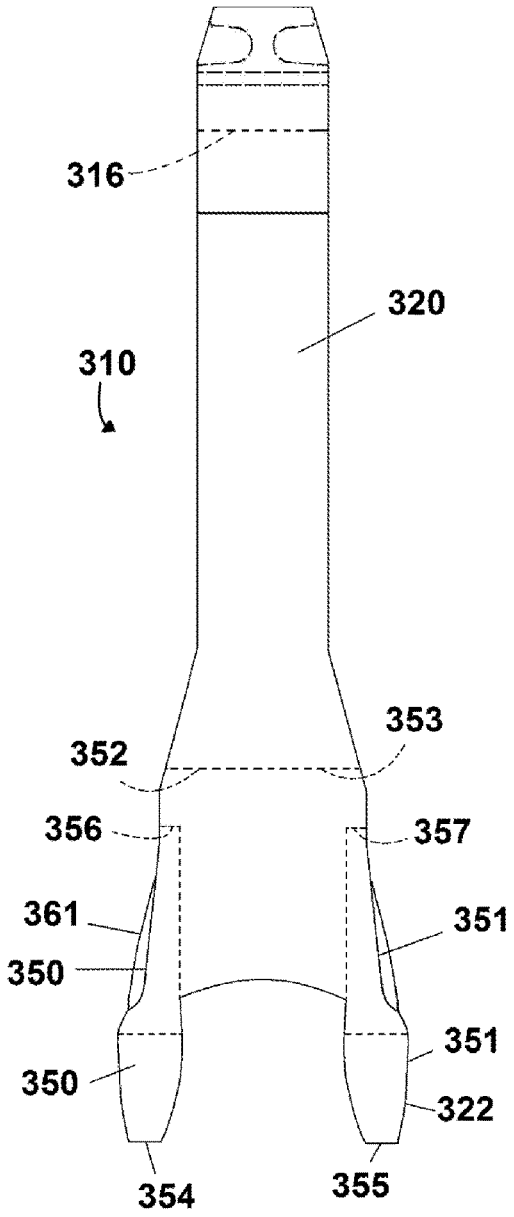
FIG. 3 is a top plan view of an alternate yoke for a railway coupling system, showing a yoke having a prior type Type E configuration shape, but being constructed according to the invention as a lightweight yoke.

According to another preferred embodiment, an alternate configuration of yoke 310 is shown configured as a type E yoke. The yoke 310 has a butt end portion 313, and also preferably has lightener pockets 314, 315. A draft gear seat 316 is shown having a substantially planar face 317. Connected to the butt end portion 313 are top and bottom straps 320, 321, which span to the yoke head 322. The yoke 310 illustrated in FIG. 3 is shown rotated ninety degrees from the position of the yoke when it is operatively installed in the center sill of a railway vehicle. Keyslot walls 350, 351 are provided in the yoke head 322, and, in the embodiment illustrated, the keyslot walls 350, 351 are outwardly divergent from one another. The keyslot walls 350, 351 span from the front draft gear walls 352, 353 from which they extend forwardly, to the nose portion 354, 355. The draft gear pocket 359 is shown defined between the rear draft gear wall face 317, the top and bottom straps 320, 321, and the front draft gear walls 352. The keyslot walls 350, 351 are provided with keyslots 356, 357, respectively, which oppose each other, as shown in FIGS. 3 and 4. The keyslots 356, 357, each preferably has a radiused configuration at each end thereof. According to a preferred embodiment the yoke 310 may have ribs 361, 362 running along the length of the keyslot 356 (and along the keyslot 357).

The yoke 310 may be configured with standard yoke contour dimensions for E-Type couplers (such as Y40 and Y41). According to preferred configurations, a yoke configured with the Y40 yoke dimension preferably has a draft gear pocket length of 25⅝ inches, and for a Y41 yoke configuration, the draft gear pocket length is 36⅜ inches long.

Alternate configurations may be made to the yoke 310 and yoke 210, including providing wall thicknesses that are reduced compared to current existing yokes, providing ribs or combinations of reduced wall thicknesses and ribs. The yokes 210 and 310 are shown as examples, and other configurations, preferably, yoke constructions meeting the standard geometries of AAR coupler yoke standards may be provided and produced in accordance with the present invention, including constructing the yoke to be lighter in weight and/or have thinner walls or wall portions, and more preferably, constructing the yokes from austempered metal.

According to preferred embodiments, the yokes, such as the yokes 210, 310 are constructed from preferred compositions of a ductile iron, which preferably is austempered.

Referring to FIG. 5, an alternate embodiment of a lightweight yoke 410 is shown having a butt end portion 413, lightener pockets 414, 415 and a draft gear seat 416 with a substantially planar face 417. Top and bottom straps 420, 421 connect to the butt end portion 413 and span to the yoke head 422 and are located on opposite sides of the draft gear pocket 459. A draft gear pocket 459 is shown defined by the front draft gear walls 452, rear draft gear wall face 417 and top and bottom straps 420,421.

In FIG. 5, the yoke 410 is shown rotated ninety degrees from the position of the yoke 410 when it is operatively installed in the center sill of a railway vehicle. The yoke head 422 preferably is constructed with a plurality of weight reduction areas. The yoke head 422 has outwardly diverging keyslot walls 450, 451 which span from the front draft gear walls 452, 453 from which they extend forwardly, to the nose portion 454, 455.

Referring to FIG. 6, a pair of broken lines is shown defining a cross-sectional thickness "a" of the keyslot wall 450 and nose portion 454. According to a preferred embodiment, the yoke is constructed having a maximum thickness at the location of the yoke 410 defined by the arrows "a". According to preferred embodiments, the maximum thickness dimension is measured by the maximum diameter of a sphere that can be within the part, and more preferably, is the maximum diameter of a sphere that can be within the yoke keyslot wall 450 and nose portion 454 shown in FIG. 6. According to preferred embodiments, the maximum thickness, as measured corresponding with the spherical dimension, is a maximum spherical diameter of about 1.25 inches, and more preferably about 1.2 to 1.15 inches. According to some preferred embodiments, the wall thickness may be a maximum of 0.75 inches, as measured in connection with the spherical diameter fitting with the wall of the yoke 410. FIG. 5 illustrates a preferred embodiment having a zone of weight reduction "z1" provided in the nose portion 454 of the yoke 410. The weight reduction zone z1 is illustrated schematically with a boxed area of the yoke 410 drawn to represent a preferred area of the yoke 410 for weight reduction. Preferably, there is a corresponding zone of weight reduction "z2" provided in the second nose portion 455 of the yoke 410. The weight reduction zone z1 preferably may comprise an arrangement of ribs, such as, for example, the ribs 471, 472, 473 shown in FIG. 5. Between the ribs 471,472,473 are spaces 475, 476, and there is a space 474 on the side of the first rib 471, and a space 477 on the side of the third rib 473. The keyslot 456 is shown with ribs 461,462 running along the length of the keyslot 456. According to a preferred embodiment, the keyslot ribs 461,462 preferably extend to join ribs on the nose portion 454 of the yoke 410. According to a preferred embodiment, ribs 471,473 join with the ribs 462,461, respectively, that are disposed on each side of the keyslot 456, and the ribs 471,473 preferably extend beyond the keyslot 456 to the nose portion 454 diverging toward an edge of the yoke 410. As shown in the yoke 410 of FIG. 5, the keyslot ribs 461,462 join, respectively, with the third rib 473 and the first rib 471. The force load distribution from loads received at the keyslot 456 preferably is distributed through the arrangement of ribs. The lightweight austempered metal construction and rib arrangement provide a lightweight yoke 410 that is both suitably strong for railway vehicle coupling operations and lightweight. Preferably, the opposite nose portion 455 also is configured with ribs and spaces similar to the arrangement shown and described in connection with the nose portion 454. Although not shown, the keyslot 457 also has keyslot ribs alongside the keyslot (one rib 461*a* being shown in FIG. 6) that preferably join with ribs on the nose portion 455 (the nose ribs 473*a* and 472*a* being shown in FIG. 6 separated by the spaces 477*a* and 476*a*, respectively). Although the zone of weight reduction z1 is illustrated with an arrangement of ribs joining the keyslot ribs, alternatively, in alternate embodiments, the zone of weight reduction z1 may comprise a dimpled surface, wherein dimples having a coring depth are distributed on the surface portions of the nose 454 or head 422 of the yoke 410. Alternate embodiments may include both an arrangement of ribs as well as dimples disposed in the yoke wall surfaces.

A weight reduction zone "z3" preferably is provided in the rear of the yoke 410. The boxed area z3 illustrates a preferred location or zone of the yoke 410 where one or more weight reduction features are provided. The weight reduction zone z3 preferably is provided in the tail section of the yoke 410. According to one preferred embodiment, the wall thickness of the yoke 410 in the zone of weight reduction z3, and preferably in one or more, any or all, of the rear wall 419, draft gear seat 416, and strap portions 420,421 connecting with the rear wall 419, is preferably configured having a maximum thickness, measured corresponding with the spherical dimension, of a maximum spherical diameter of less than about 1.25 inches, more preferably, less than about 1.2 to 1.15 inches, and most preferred about or less than 0.75 inches. According to one embodiment, the weight reduction zone z3 includes a plurality of dimples, such as those dimples 481,482 shown in the top of the yoke 410, and the dimples 483,484, 485,486 shown in the wall 490 of the rib 413. Although the exemplary embodiment illustrated in FIGS. 5 and 6 shows a preferred arrangement of dimples, other arrangements of dimples may be provided, including providing dimples on the opposite sides of the surfaces, and, more preferably, staggering the dimples on opposite surface sides to provide an increased continuous thickness across the part. Although six dimples are shown in the exemplary embodiment, a plurality of dimples, which may number greater than the six shown, may be provided in the surfaces of the yoke 410 at locations of the yoke 410, including, preferably, one of the preferred weight reduction zones z1, z2, z3, or other surfaces of the yoke 410.

According to an alternate embodiment, ribs may be provided in the rear section of the yoke 410. For example, the weight reduction zone z3 may include a plurality of ribs in the locations at the top or bottom surfaces of the walls, such as, for example, the rear wall 419, the draft gear seat 416, or both. According to one embodiment, U-shaped ribs are provided running in the direction of the yoke, which in some embodiments may include crossing ribs that cross each other. A plurality of ribs may be provided in the tail section of the yoke 410.

Referring to FIGS. 7-11, an alternate embodiment configured as an E-type yoke 510 is shown. The yoke 510 includes a head 511 at one end thereof and a butt portion 512 at the other end thereof. Connected to the butt end portion 512 are top and bottom straps 520,521, respectively, which span to extend to the yoke head 511. A draft gear seat 513 is shown having a substantially planar surface 513*a*. The yoke head 511 includes keyslot walls 515,516 which, in the embodiment illustrated, are outwardly divergent from one another. The keyslot walls 515,516 span from the front draft gear walls 522,523 from which they extend forwardly, to the nose portion 524,525. The draft gear pocket 526 is shown defined between the rear draft gear wall face 513*a*, the top and bottom straps 520,521, respectively, and the front draft gear walls 522,523. The keyslot walls 515,516 are provided with keyslots 527,528, respectively, which oppose each other, as shown in FIGS. 7, 9, 10 and 11. Each keyslot 527,528 preferably has a radiused configuration at each end thereof. In addition to the keyslot walls 515,516, the head 511 also is shown having a first wall and a second wall, which may be referred to as a top wall 531 and a bottom wall 532.

The yoke 510 may be configured with standard yoke contour dimensions for E-Type couplers (such as Y40 and Y41). According to preferred configurations, according to one exemplary embodiment, a yoke configured with the Y40 yoke dimension preferably has a draft gear pocket length of 24⅝ inches, and for a Y41 yoke configuration, the draft gear pocket length is 36 inches long. According to preferred embodiments, the draft gear pocket 526 preferably is sized and dimensioned in accordance with AAR specifications and standards to accommodate a draft gear and/or other components that may be installed for the coupling assembly. According to a preferred embodiment, the E-type yoke may have a preferred length of 41⅛".

According to a preferred embodiment illustrated, openings 535,536 are provided in the respective straps 520,521. The openings 535,536 in the straps 520,521 preferably oppose each other. According to a preferred embodiment, the openings 535,536 are elongated to span across the straps 520,521. The openings 535,536 are shown having radiused ends and a straight elongated portion. The straps 520,521 may be constructed in accordance with an AAR standard, which in some preferred embodiments is 5 inches in height. The openings 535,536 are preferably provided within the 5 inches of strap height. According to a preferred embodiment, the height H1 of the openings 535,536 preferably are up to about one half of the strap height H2, as depicted according to a preferred embodiment shown in FIG. 9. According to one preferred embodiment, the strap height H2 is 5 inches and the opening height H1 is 2½ inches.

According to one embodiment, the draft gear pocket 526 may be 25 inches (measured from a plane of the rear surface 513*a* to a plane of the draft gear pocket front walls 522,523). According to one preferred embodiment, the openings 535, 536 are provided at a central location of the straps 520,521, relative to the strap height. According to one embodiment, the openings preferably are provided to be located within about 1.5 inches from the edge of a strap wall.

Figure 10:
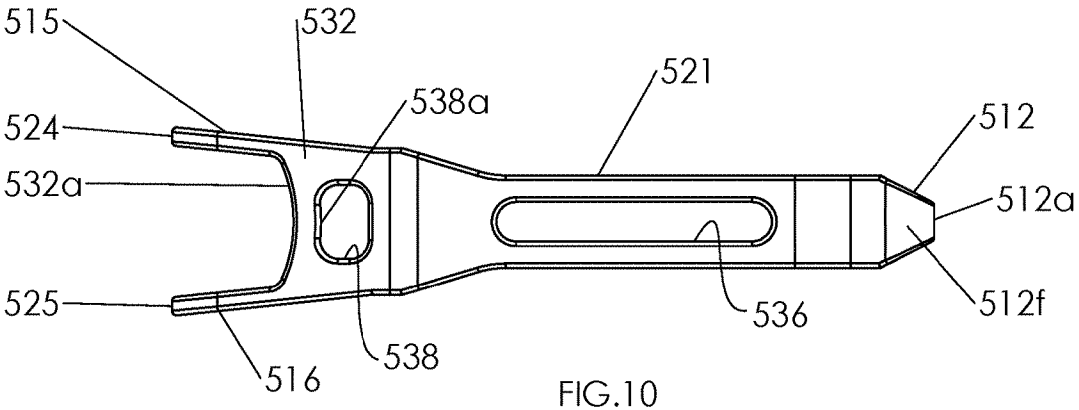
FIG. 10 is top plan view of the E-type yoke of FIG. 7, looking overhead at the yoke.
Figure 7:
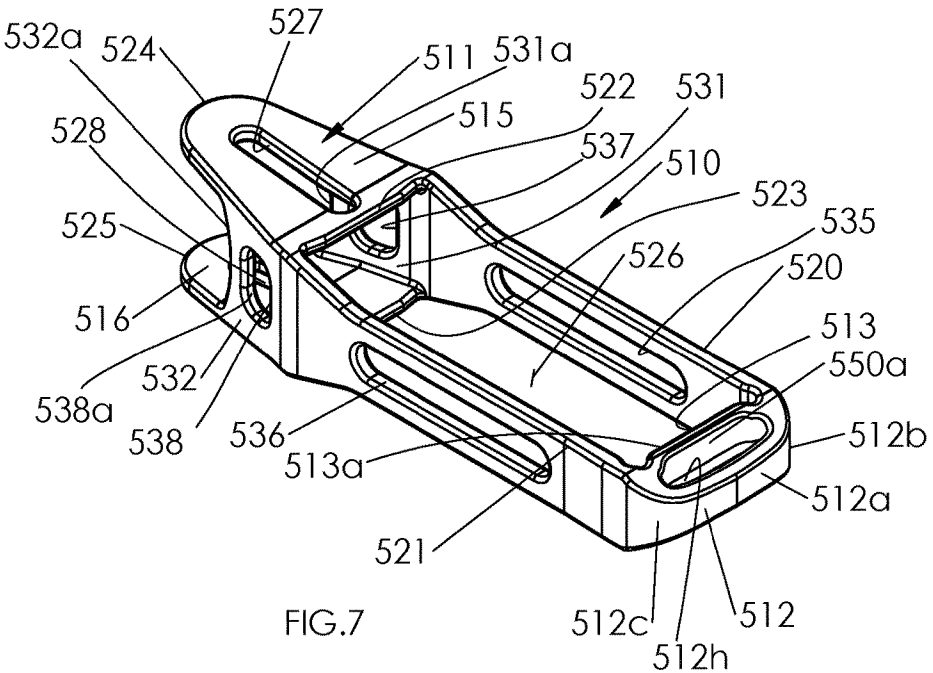
FIG. 7 is a perspective view of an alternate embodiment of an E-type yoke according to the invention.
Figure 9:
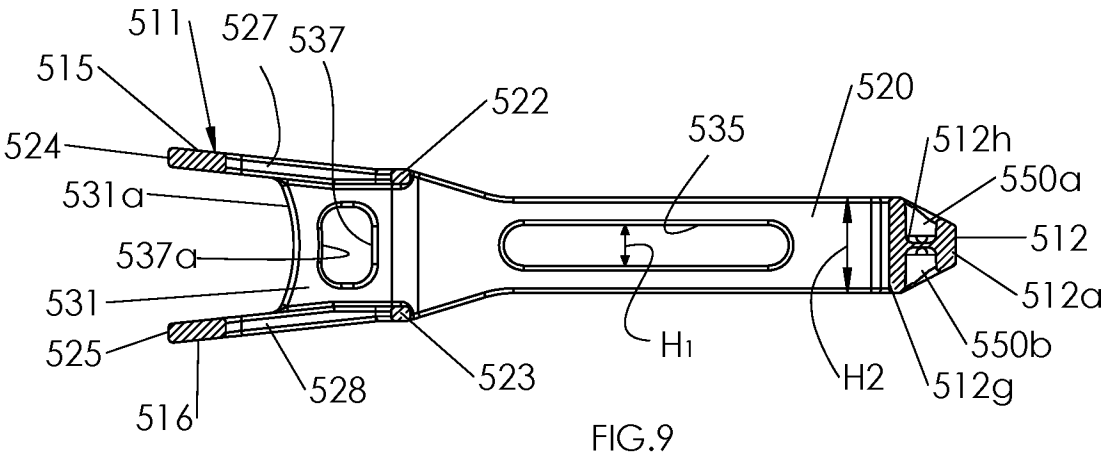
FIG. 9 is view looking from the bottom toward the top of a section of the yoke of FIG. 14, taken along the section line 9-9 of FIG. 8.

Referring to FIGS. 7, 9 and 10, the top wall 531 and bottom wall 532 of the head portion or head 511 preferably have wall openings 537,538, respectively, disposed therein. According to a preferred embodiment, the wall openings 537,538 are provided to oppose each other, and preferably, the openings 537,538 are centrally located in the top and bottom walls 531,532, respectively. According to a preferred embodiment, the top wall 531 and bottom wall 532 have a curved or radiused edges 531*a*,532*a*, respectively, which are provided at the front wall end. According to a preferred embodiment, the openings 537,538 preferably are provided with a forward portion 537*a*,538*a*, which is radiused or curved. According to some preferred embodiments, the radiused or curved forward portion 537*a*,538*a* of the respective top and bottom wall openings 537,538 has a profile corresponding with the radius or curve of the top and bottom front wall edges 531*a*,532*a*. In a preferred embodiment, the wall openings 537,538 have radiused or curved corners. As illustrated the top and bottom walls 531,532, respectively, support the yoke 510 and the keyslot walls 515,516 connecting to the respective top and bottom walls 531,532.

According to a preferred embodiment, the thickness of the yoke walls preferably may be constructed to be from about 1.25 inches to about 0.25 inch. For example, the thickness of the walls forming the straps 520,521 may be from about 1 inch to 1.25 inches, with a preferred thickness of about 1.125 inches. According to some embodiments, the top and bottom walls 531,532 of the head portion 511 may have a wall thickness that is similar to the walls of the straps 520,521. Preferably the thickness of the keyslot walls 515,516 may be provided to be about 1.25 inches or less, and according to some preferred embodiments, the thickness of the keyslot walls 515,516 is about 1 inch. According to a preferred embodiment, the wall thicknesses of the key slot walls 515,516, the straps 520,521 and top and bottom walls 531,532 may be from about 1 inch to 1.25 inches, wherein each wall or strap pair may have a thickness within this range, which may be a different thickness than the other wall pair or strap pair. According to a preferred embodiment, each strap 520,521 preferably may have a uniform thickness along its length between joining locations (which is shown joining with the butt end 512 at one end thereof, where a radiused fillet may be provided (FIG. 9), and joining with the head 511 at the other end thereof, which also may have a radiused fillet at the head portion 511.

Figure 11:
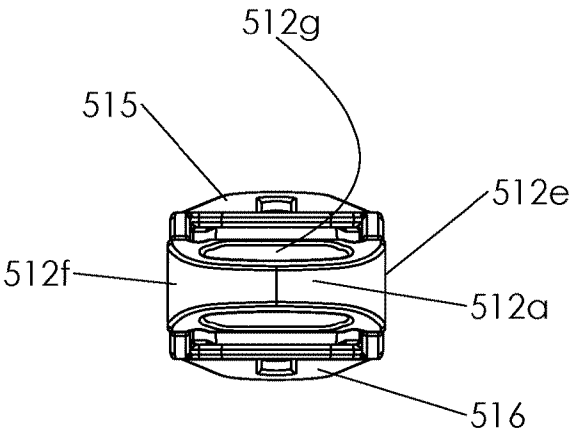
FIG. 11 is a rear elevation view of the yoke of FIG. 7, shown with the yoke resting on a side.
Figure 8:
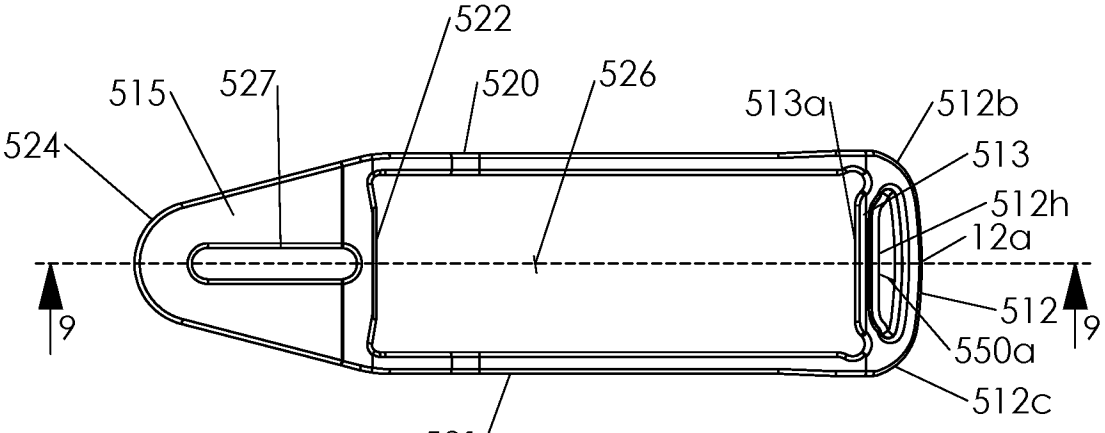
FIG. 8 is a side elevation view of the E-type yoke of FIG. 7, depicted in an orientation in which the yoke is used in operation.
Figure 15:
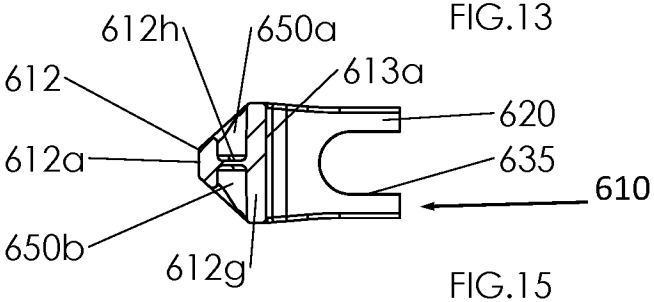
FIG. 15 is a sectional view of the butt end portion of the yoke of FIG. 12, broken away from the other portions of the yoke, and taken along the section line 15-15 of FIG. 14.

According to a preferred embodiment, as illustrated, the yoke 510 has a butt end portion 512 disposed opposite the head portion 511. The butt end portion 512 is shown having radiused or curved edges 512*b*,512*c*, and a pair of pockets 550*a*,550*b* (see FIG. 9) provided in the butt end portion 512. Referring to FIG. 11, the butt end portion 512 is shown having tapered side wall portions 512*e*,512*f* which taper inwardly toward the center of the butt end portion 512. The butt end portion 512 is shown with a rear wall portion 512*a* formed by the narrowing of the converging side wall portions 512*e*,512*f*. Referring to FIG. 15, the butt end portion 512 is shown having an inner wall portion 512*g* which preferably is connected with the rear wall portion 512*a*. According to a preferred embodiment, the inner wall portion 512*g* connects with the rear wall portion 512*a* by a connecting structure, which in the preferred embodiment illustrated, is shown as a rib or wall 512*h*. The connecting rib or wall 512*h* preferably is transversely disposed and is provided at the mid level of the height of the butt end portion 512, such as, for example, the height of the inner wall 512*g*. The inner wall 512*g* according to some preferred embodiments may be formed from the wall that forms the draft gear seat 513 and may be coextensive with it, or formed such that the draft gear surface 513*a* is on one side of the wall and the rear surface of the draft gear seat wall faces into the cavities or pockets 550*a*,550*b*.

Figure 12:
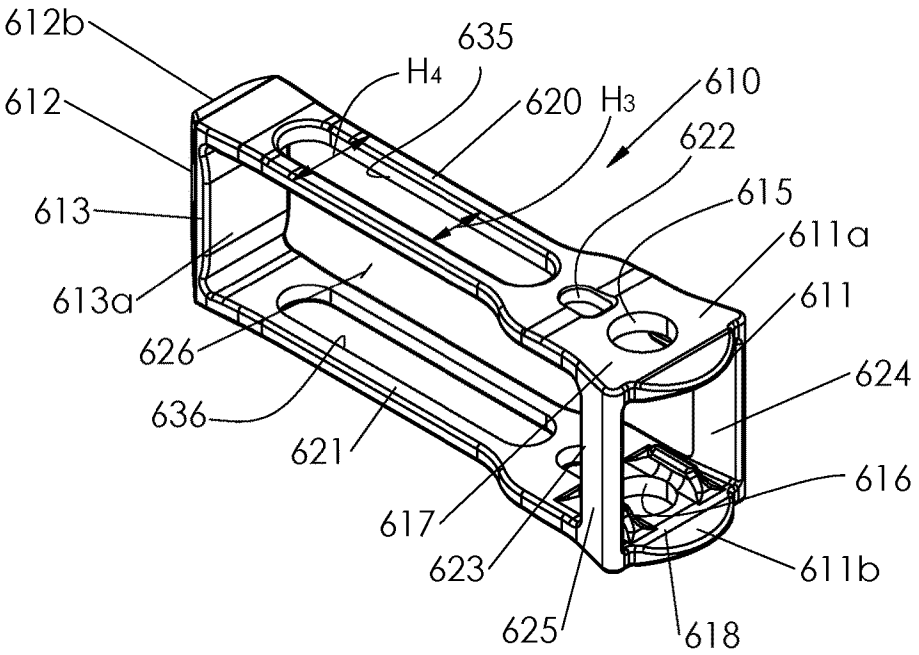
FIG. 12 is a perspective view of an F-Type yoke according to the invention.

Referring to FIGS. 12-16, an alternate embodiment of a yoke 610 is shown configured as an F-type coupler yoke. The yoke 610 is generally oriented vertically when in use, as depicted in the view of FIG. 12, where the pin bores 615,616 are shown located vertically to receive a connecting member, such as a pin (not shown) to connect with a component of a coupling assembly (e.g., a coupler). The yoke 610 has a head or head portion 611 at one end thereof and a butt portion 612 at the other end thereof. The head portion 611 preferably includes an upper head portion 611*a* and lower head portion 611*b*. Connected to the butt end portion 612 are top and bottom straps 620,621, respectively, which span to extend to the yoke head 611. A draft gear seat 613 is shown having a substantially planar surface 613*a*. The yoke head 611 includes pin bores 615,616 which are provided in the respective top and bottom walls 617,618 of the head 611. According to a preferred embodiment illustrated, the top and bottom walls 617,618 may be outwardly divergent from one another. Preferably, an upper window 622 and lower window 623 are formed in the respective top and bottom walls 617,618 through which observation of the draft gear (not shown) may be made when the yoke is installed in an assembly with other coupling components. A front supporting structure, shown including a pair of side walls 624,625 is provided, and connects the upper front wall portion or wall 617 with the lower front wall portion or wall 618. A pocket 626 is shown provided between the draft wall surface 613*a* and the yoke head portion 611.

The yoke 610 is shown according to a preferred embodiment, with strap openings 635,636 provided in the respective straps 620,621. The strap openings 635,636 preferably oppose each other. According to a preferred embodiment, the strap openings 635,636 are elongated to span across the straps 620,621. The strap openings 635,636 are shown having radiused ends and a straight elongated portion. The straps 620,621 may be constructed in accordance with an AAR standard, which in some preferred embodiments is 5¾ inches in height (as viewed in FIG. 13, where a strap height H4 is represented). The strap openings 635,636 are preferably provided within the 5¾ inches of strap height dimension H4. According to a preferred embodiment, the height H3 of a strap opening 635,636 preferably is up to about one half of the strap height H4, as depicted according to a preferred embodiment shown in FIG. 19, showing the strap 635. According to one embodiment, yoke 610 may have an overall length of 37½ inches, with the draft gear pocket 626 having a length of 24⅝ inches, (measured from the rear surface 613*a* to a point 4 17/32 inches behind the center point of the pin or pin bore 615,616). According to a preferred embodiment, the rear surface 613*a* to the center of a pin bore 615,616 is 29 5/32 inches. According to one preferred embodiment, the strap openings 635,636 are provided at a location between the butt end portion 612 and the head portion 611. According to one embodiment, the openings preferably are provided to be located within about 1 inch to 1.5 inches, and preferably about 1.25 inches to 1.375 inches from the edge of a strap wall. According to a preferred embodiment, the straps 620,621 may increase in width at the locations near each of the ends of the respective straps 620,621, including, for example, at the strap locations where the front and rear of the openings 635,636 begin or end.

Figure 16:
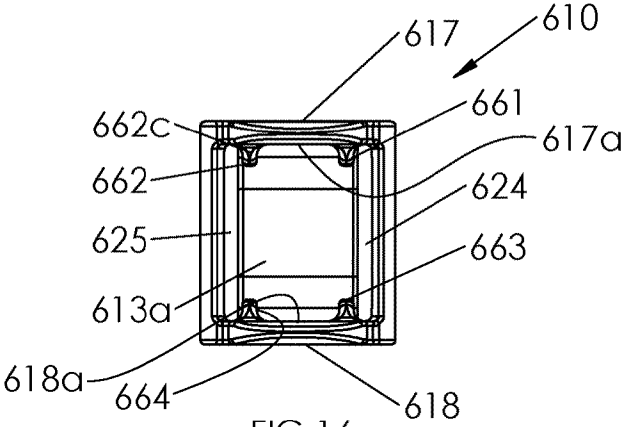
FIG. 16 is a front elevation view of the yoke of FIG. 12.
Figure 14:
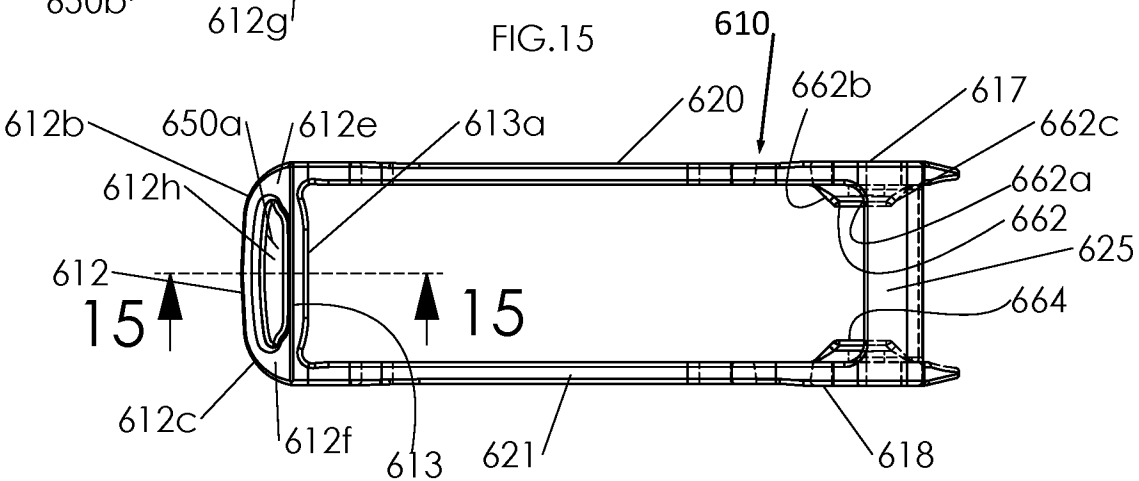
FIG. 14 is a right side elevation view of the yoke of FIG. 12.

According to a preferred embodiment, the thickness of the walls of the yoke 610 preferably may be constructed to have thicknesses between about 1.25 inches to about 0.25 inch. For example, the thickness of the walls forming the straps 620,621 may be from about 1 inch to 1.25 inches, with a preferred thickness of about 1.125 inches. According to some embodiments, the top and bottom walls 617,618 of the head portion 611 may have a wall thickness that is similar to the walls of the straps 620,621. The top and bottom walls 617,618 may comprise extensions of the respective straps 620,621 and have similar thicknesses or, alternatively, have different thicknesses than the respective straps 620,621. Accordingly, the pin bores 615,616 preferably have a depth corresponding with the thickness of the respective top and bottom wall 615,616, or respective top or bottom strap 620,621. According to a preferred embodiment a positioning feature is provided at the yoke head portion 611. Referring to FIG. 16, the positioning feature is shown in accordance with a preferred construction as a plurality of positioning tabs 661,662 provided on the inner surface 617*a* of the top wall portion 617, and positioning tabs 663,664 provided on the inner surface 618*a* of the lower wall 618. The positioning feature facilitates even loading to control and distribute loads, for example, from a coupler shank. The positioning tabs 661,662,663,664 preferably comprise wear surfaces and preferably are constructed from the same composition as the other portions of the yoke 610. Preferably the positioning tabs, such as the upper tabs 661,662 and lower tabs 663,664, are provided in opposing relation to each other so that the upper tabs 661,662 face the lower tabs 663,664, with each upper tab 662,662, facing a respective lower tab 663,664. As shown in FIG. 14, the tab 662 has a generally flat or substantially flat inner surface portion 662*a* and has tapered sides 662*b*,662*c*. Preferably, the other tabs 661,663,664 also are constructed having a flat or substantially flat inner surface portion and tapered sides. The tabs 661,662,663,664 narrow the opening provided at the head 611 of the yoke 610. According to one preferred embodiment, the tab pairs 661,662 and 663,664 are disposed proximate the respective pin bore openings 615,616, with each tab of a pair being provided on an adjacent side of a respective pin bore opening 615,616.

Figure 13:
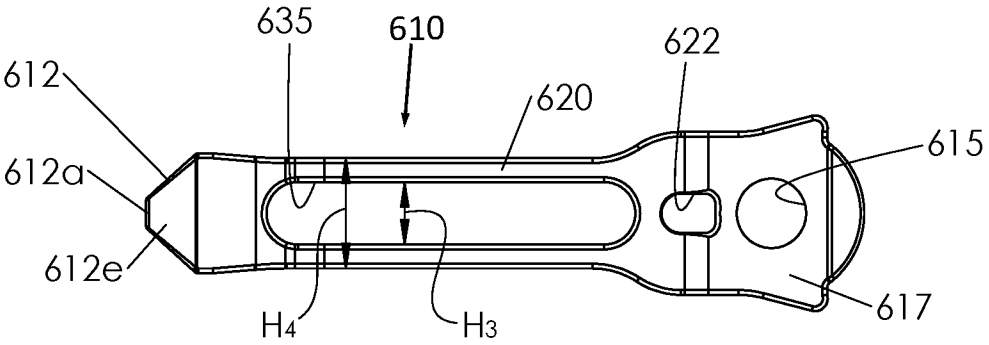
FIG. 13 is a top plan view of the yoke of FIG. 12.

According to a preferred embodiment, as illustrated, the yoke 610 has a butt end portion 612 disposed opposite the head portion 611. The butt portion 612 is shown having radiused or curved edges 612*b*,612*c*, and pockets 650*a*,650*b* provided in the butt end portion 612. According to preferred embodiments, the pocket arrangement includes a first pocket 650*a* and second pocket 650*b*. Referring to FIGS. 13,14 and 15, the butt end portion 612 is shown having tapered side wall portions 612*e*,612*f* which taper inwardly toward the center of the butt end portion 612 (similar to the walls 512*e*,512*f* of the butt end portion 512 shown in FIG. 11, in connection with the yoke 510). The butt end portion 612 is shown with a rear wall portion 612*a* formed by the narrowing of the converging side wall portions 612*e*,612*f*. Referring to FIG. 15, the butt end portion 612 is shown having an inner wall portion 612*g* which preferably is connected with the rear wall portion 612*a*. According to a preferred embodiment, the inner wall portion 612*g* connects with the rear wall portion 612*a* by a connecting structure, which in the preferred embodiment illustrated, is shown as a rib or wall 612*h*. The connecting rib or wall 612*h* preferably is transversely disposed and is provided at the mid level of the height of the butt end portion 612, such as, for example, the height of the inner wall 612*g*. The inner wall 612*g* according to some preferred embodiments may be formed from or be part of the wall that forms the draft gear seat 613 and may be coextensive with it, or formed such that the draft gear surface 613*a* is on one side of the wall and the rear surface thereof faces into the cavities or pockets 650*a*,650*b*.

According to a preferred embodiment, the front portion of the straps 620,621 may be constructed to slightly taper inwardly at the head portion 611. According to a preferred embodiment, the inwardly taper of the straps 620,621 preferably is after the front of the openings 635,636, and the straps 620,621 and head walls 617,618 that join with straps 620,621, respectively, also may have an inward taper. According to a preferred embodiment, a further inward taper of the front portions of the walls 617,618 may be provided, and the inward taper may include a portion of converging wall thickness in the front of each wall 617,618, preferably at each front flange 617*b*,618*b*.

According to some embodiments, the yoke 610 may be configured with standard yoke contour dimensions for F-Type yokes. According to preferred configurations, a yoke configured with the S-149 yoke dimension preferably has a draft gear pocket length of 24⅝ inches and a length of 37½ inches. The spacing between the straps 620,621, as depicted in FIG. 20, preferably, meets or exceeds the AAR standards (including any allowable tolerances) so the pocket 626 formed between the straps 620,621 may accommodate coupling components (e.g., a draft gear). According to some preferred embodiments, the yoke height, as shown by reference to the orientation in FIG. 20, may have a height of about 11½ inches. The yoke 610 preferably may be configured with dimensions that meet the AAR specifications for F-type yokes including with any permitted tolerances, and, may exceed the specifications.

According to a preferred embodiment, the yokes 210,310, 410,510,610 are constructed from an austempered metal, and more preferably, from austempered ductile iron (ADI). Although other austempered metals may be used, and other grades of ADI, according to a preferred embodiment, yokes may be constructed from Grade 3 ADI. According to a preferred embodiment, the ADI may be Grade 3 ADI in accordance with ASTM A897/A897M for ADI castings. According to some preferred embodiments, yokes 10,110 may have properties that meet or exceed the specifications for Grade 3 ADI.

The yoke preferably joins with a coupler that carries a pivotally connected knuckle movable between open and closed positions. According to alternate embodiments, the yokes 210, 310,410,510,610 may be made from austempered steel, which may be an austempered alloy steel. Other austempered metals, such as, for example, austempered ductile iron, and austempered metal alloys, may be used to construct the yokes 210,310,410,510,610. As discussed herein, the coupler, as well as the knuckle used in conjunction with the yoke 210,310,410,510,610 also may be constructed from austempered metal. As discussed above in connection with the couplers, preferred compositions, such as steel, as well as alloy steel compositions, e.g., alloyed preferably with magnesium, manganese, molybdenum, copper or mixtures thereof, or more preferably, with chromium, nickel or mixtures thereof, (or mixtures of the preferred and more preferred metals), may be used to form the yokes 210,310,410,510,610. The steel or preferred/more preferred alloy steel composition is austempered to obtain tensile strength, yield, and elongation properties for the inventive yokes which are suitable to meet or exceed the AAR standards for yokes utilized in coupling systems, including the current standard set forth by the American Association of Railroads (AAR) in AAR Manual of Standards and Recommended Practices, such as current standard M-211, M-205, M-220 NDT and Rule 88 of the AAR Office Manual, the complete contents of which are herein incorporated by reference. Like the couplers discussed herein, the yokes 210,310,410,510,610, according to preferred embodiments, may be constructed from ductile iron that is austempered. The ductile iron also may be used in alloy form, preferably, with nickel, molybdenum, manganese, copper, or mixtures thereof, to form the yokes 210, 310,410. The yokes 210.310.410.510,610 may be produced using any suitable production method. According to one method, the yoke 210,310,410,510,610 may be formed from a casting. For example, where the casting of the yoke is made from ductile iron, the ductile iron casting may be subjected to an austempering process to produce an austempered ductile iron yoke.

According to preferred embodiments, yokes of the invention, such as the yokes, 210, 310, 410, 510, 610, may be constructed from austempered ductile iron. The austempered ductile iron is produced by a suitable austempering process. For example, austempering of ductile iron may be accomplished by heat-treating cast ductile iron to which specific amounts of nickel, molybdenum, or copper or combination thereof have been added to improve hardenability; the quantities of the elements needed to produce the ADI from ductile iron are related to the thickest cross section of the yoke; the thicker the cross section the more alloy is needed to completely harden the metal. Austempered steel and other austempered metals and austempered metal alloys, may be produced by any suitable austempering processes. Austempered steel is produced by a suitable austempering process. For example, austempering of steel may be accomplished by heat-treating cast steel to which specific amounts of chromium, magnesium, manganese, nickel, molybdenum, or copper or combinations thereof have been added to improve hardenability; the quantities of the elements needed to produce the austempered steel from the cast alloy steel are related to the yoke configurations and, for example, depend on the thickest cross sectional area of the yoke. The yokes are constructed from a material that has a specific gravity that is less than that of alloy steel, but yet provides suitable strength. The material may have a specific gravity of about 0.26 lbs/in3.

According to preferred embodiments, yokes are constructed from austempered ductile iron, and according to a preferred embodiment, they are formed from austempered ductile iron having a minimum tensile strength of 130 ksi, a minimum yield strength of 90 ksi, and a minimum elongation in 2 inches of 2%. Additionally, some preferred embodiments have a BHN (Brinell hardness number) within a range of about 302 to about 460. According to some more preferred embodiments, yokes are formed from austempered ductile iron having a minimum tensile strength of 190 ksi, a minimum yield strength of 160 ksi, and a minimum elongation in 2 inches of 7%. The yokes also may have a BHN within a range of about 302 to about 460. According to a preferred embodiment, the ADI is a 190/160/7 in a standard 1" Y-block. In accordance with preferred embodiments, the ADI formed yokes have carbon equivalency (CE) range of from about 4.3 to about 4.73, and more preferably, has a CE range of from about 4.3 to 4.6. Since alloying elements other than carbon are used in the preferred embodiments, the carbon equivalency provides a value taking into account a conversion of the percentage of alloying elements other than carbon to the equivalent carbon percentage. Iron-carbon phases are better understood than other iron-alloy phases, so the carbon equivalency (CE) is used. A convenient method to accomplish this is to combine the elements of the chemical composition into a single number, equaling the carbon equivalent.

There are a number of formulas for ascertaining carbon equivalency. Generally, three primary carbon equivalent formulae have been commonly used in prediction algorithms for hydrogen-assisted cracking of steels. These include: Pcm, CEIIW and CEN. According to preferred embodiments, preferred CE values for ADI used to construct the yokes is determined by: CE=% C+1/3 (% Si). According to preferred embodiments, the iron is alloyed with additional components, including those set forth in the formulas below. Preferred embodiments of the yokes are constructed from ADI that has an alloy content that is greater than 4.0%. Further preferred embodiments of the yokes are constructed from ADI having alloy content greater than 4.0% and a carbon equivalency value of 4.37 to 4.73.

According to some preferred embodiments, ADI yokes are made in accordance with the following composition:

| | |
|---|---|
| Carbon Equivalent | 4.37-4.73 |
| Carbon | 3.60-3.80% |
| Silicon | <2.60%; |
| Copper | 0.50-0.70% |
| Manganese | 0.35-0.45% |
| Nickel | <0.03% |
| Chromium | <0.05% |
| Magnesium | 0.030-0.050% |
| Iron | balance of the composition. |

In one proposed example, the above composition is cast in a mold to form a yoke (which may be a Type-E or Type F yoke). Cores, such as sand cores, may be used to define cavities that will be formed in the completed respective yoke. The molten metal may be introduced into the mold cavity or cavities through one or more gates. When the molten metal has filled the mold cavities, and it is allowed to solidify. The yoke casting is removed from the mold, and cores are removed from the respective casting, or broken apart if required for their removal. The yoke castings are austempered through a series of heating and cooling steps. The cast iron is raised to a heating temperature above the Ae3 temperature, or above 910 degrees C. (Modern Physical Metallurgy, R. E. Smallman, A. H. W. Ngan, Chapter 12, Steel Transformations, p. 474, FIG. 12.1) After heating to above about 910 degrees C., the respective yoke casting is then rapidly quenched and held at the lower temperature. According to this proposed example, the resultant yoke formed from the composition and ADI, is a 190/160/7 ADI.

According to preferred embodiments, the walls have carbon equivalent (CE) in a prescribed range. One way in which the carbon equivalent (CE) value is expressed, is CE=% C+1/3 (% Si). According to preferred embodiments, the CE range is about 4.3 to about 4.6. According to preferred embodiments, where the wall thickness is between about 0.25" to 2", the yoke wall has a CE range of from about 4.3 to about 4.6, and where the wall is over 2", then the CE range is between about 4.3 to 4.5. In addition, preferred embodiments of the ADI yokes are constructed from a casting that has minimum nodularity properties. According to preferred embodiments, the ADI yoke castings have a minimum nodule count of 100/mm2 and minimum nodularity of 90%.

According to another preferred formulation, the ADI casting is made from a composition as follows:

| Elements | Percentage | Preferred Control Range |
|---|---|---|
| C Carbon | 3.6% | +/−0.20% |
| Si Silicon | 2.5% | +/−0.20% |
| Mg Magnesium | (% S × 0.76) + 0.025% | +/−0.005% |
| Mn Manganese | | |
| Max. section > ½" | 0.35% maximum | +/−0.05% |
| Max. section < ½" | 0.60% maximum | +/−0.05% |
| Cu Cooper | 0.80% maximum (only as needed) | +/−0.05% |
| Ni Nickel | 2.00% max. (only as needed) | +/−0.10% |
| Mo Molybdenum | 0.30% max. (only as needed) | +/−0.03% |
| Sn Tin | 0.02% max. (only as needed) | +/−0.003% |
| Sb Antimony | 0.002% max. (only as needed) | +/−0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |
| Te Tellurium | 0.003% maximum | |
| Iron | Balance of formula | |

Iron being the balance of the composition, which may range from about 89 to about 95%.

According to preferred embodiments, the yokes include at least some walls whose thicknesses are greater than ¾". Some preferred embodiments are constructed from ADI of the above formulas, wherein hardening alloys are added to the ductile iron forming the casting so as to reduce pearlite formation during the austempering quenching step. Preferred hardening alloys include alloying elements, such as Mo, Cu and Ni. The hardening alloys may be added, preferably, in amounts less than or up to the maximum respective amount. For example, in the first listed formula set forth above, the hardening alloys may be added to the formula up to the maximum amounts specified in the second listed formula (above).

According to preferred embodiments, the ADI yokes may be formed with an ADI alloy that contains nodulizing elements. One example of a preferred embodiment, includes Mg as a nodulizing element. In addition, according to alternate embodiments, other examples of nodulizing elements, include beryllium, calcium, strontium, barium, yttrium, lanthanum and cerium. Although Mg is used in preferred embodiments, in other embodiments an alternative nodulizing element or combination of elements may be used. According to preferred embodiments, the amount of residual Mg plus the amounts of other nodulizing elements (e.g., beryllium, calcium, strontium, barium, yttrium, lanthanum and cerium) is less than or up to about 0.06%. According to some preferred embodiments, Ce may be used as an alloy to facilitate nodulization. According to some preferred embodiments, the ADI yokes are produced by forming a ductile iron casting, and subjecting the casting to an austempering process of elevated temperatures and quenching. The ADI yokes according to the invention are produced to have high nodularity and nodule formation throughout the solidification of the ADI yoke ADI castings, which is preferably done using an inoculant. According to preferred embodiments, a mixture of La, Ca, S and O is provided in the inoculant. The inoculant may be referred to as a post inoculant, as the ductile iron may be alloyed with one or more alloy elements, and, the inoculant may be a separate addition, added to the molten ductile iron/alloy or mold to which the molten ductile iron/alloy is being added. The yokes of the invention preferably are produced using ductile iron, to which small amounts of other elements have been added, as discussed herein, and to include in the addition thereto, preferably, at the molten stage of the ductile iron/alloy, an inoculant. The inoculant preferably is an element or combinations of elements that increase nodule formation. According to a preferred embodiment, the inoculant is selected from the group consisting of La, Ca, S and O (and mixture thereof). The inoculant may be added to the stream of molten metal (the molten ductile iron and alloy components) as it is poured into the mold. Alternatively, the inoculant is added to ductile iron by adding the inoculant in the mold. Preferred embodiments of the ADI yokes are produced from inoculated ductile iron (by an addition of the inoculant to the molten material as it is being admitted to the mold, or introducing the inoculant to the mold into which the molten ductile iron is to be admitted). The inoculated ductile iron casting is then austempered. The increased nodule formation and high nodularity throughout the improved yokes provides improvements in strength, particularly an increase resistance to fatigue and cracking.

According to embodiments, the yokes are constructed having a high nodule count, high nodularity, or both. According to some preferred embodiments, the nodularity and nodule count may be optimized. Yokes according to preferred embodiments are constructed having a minimum nodule count, which may be expressed in a number of nodules per unit of area. For example, according to some preferred embodiments, the ADI yokes are constructed having a nodule count that is at least 90 per mm2, and preferably, at least 100 per mm2. Some preferred embodiments of the ADI yokes are provided having nodularity that is a minimum of 80%, and more preferably, at least 90%. According to some preferred embodiments, yokes are constructed from ADI and have, both a nodule count that is at least 90 per mm2, and preferably, at least 100 per mm2, and also have nodularity that is a minimum of 80%, and more preferably, at least 90%.

According to preferred embodiments, the wall thicknesses of the yoke may be constructed to be lighter, yet at the same time, impart suitable strength characteristics. The invention further provides embodiments of yokes with improved constructions having walls that have thicknesses that allow for improved configurations.

The yokes, such as those 210,310,410,510,610 are constructed being formed from walls. According to some preferred embodiments, the walls are typically referred to as straps, and may comprise a top and bottom strap. Other walls include top and bottom walls (or side walls depending on the orientation) of the head and keyslot walls, and walls joining the straps. The yoke walls generally have a thickness, and may define a space therebetween. According to some embodiments, the wall thickness of the straps, the head walls, and keyslot walls may be the same, and according to other embodiments, one or more of the walls defining the yoke may be different. According to some embodiments, the wall thicknesses of walls forming the yoke may be the same, and in other embodiments, the wall thicknesses of the walls forming the yoke may be different.

Preferred embodiments of a yoke, which may include any of the yokes 210,310,410,510,610 shown and described herein, are constructed from austempered ductile iron, and have a preferred wall thickness of from about 0.25"-2.5", and more preferably, from about 0.375" to about 1.75". Yokes are comprised of walls, and the walls have thicknesses. According to some embodiments, the yoke may have walls comprising a head portion located at one end thereof with an opening therein, and a rear portion; two elongated strap portions, the strap portions spanning from the head portion to the rear portion, with the rear portion joining the strap portions. A central pocket with two open sides is formed by the two elongated strap portions. According to some preferred embodiments, walls forming the yokes preferably have thicknesses between about 0.375" and 2.25".

Preferred embodiments of a yoke are constructed from austempered ductile iron, and have a preferred wall thickness of from about 0.25"-3.0", and more preferably, from about 0.6875" to about 2.25". According to some preferred embodiments, the yoke is constructed so that at least one wall has a maximum thickness of about 0.6875". According to another preferred embodiment, the yoke is constructed so that at least one wall has a maximum thickness of about 0.25". According to some preferred embodiments, the yoke is constructed so that the walls have a maximum thickness of about 3.0". According to another preferred embodiment, the yoke is constructed so that the walls have a maximum thickness of about 2.25". Other preferred embodiments include yoke embodiments where at least one wall has a maximum thickness of 0.25" and the remaining walls are within a thickness range where the maximum wall thickness for any walls is 3.0". Still other preferred embodiments include yoke embodiments where at least one wall has a maximum thickness of 0.25" and the remaining walls are within a thickness range where the maximum wall thickness for any walls is 2.25". According to yet other preferred embodiments, the yoke has at least one wall with a maximum thickness of 0.6875" and the remaining walls are within a thickness range where the maximum wall thickness for any walls is 3.0". Still other preferred embodiments include yoke embodiments where at least one wall has a maximum thickness of 0.6875" and the remaining walls are within a thickness range where the maximum wall thickness for any walls is 2.25". The walls forming the yoke (e.g., the top and bottom straps, top and bottom head walls, and keyslot walls, and other connecting walls) may be constructed to have thicknesses within the ranges and preferred ranges discussed herein. According to some preferred embodiments, the walls forming the yoke may have the same or different thicknesses from other walls forming the yoke.

According to preferred embodiments of the invention, yokes are constructed from an austempered metal, preferably austempered steel, austempered ductile iron, austempered steel alloy or austempered ductile iron alloy. Preferred compositions, such as steel, as well as alloy steel compositions, e.g., alloyed preferably with magnesium, manganese, molybdenum, copper or mixtures thereof, or more preferably, with chromium, nickel or mixtures thereof, (or mixtures of the preferred and more preferred metals), may be used to form the yokes shown and described herein. The steel or preferred/more preferred alloy steel composition is austempered to obtain tensile strength, yield, and elongation properties for the inventive yokes which are suitable to meet or exceed the AAR standards for yokes, including the current standard set forth by the American Association of Railroads (AAR) in AAR Manual of Standards and Recommended Practices. For example, yokes may be constructed in accordance with standards that indicate the gear pocket dimensions, or yoke dimensions (e.g., for Type-E and Type-F yokes). Yokes may be constructed in accordance with AAR standards and tolerances, which the present yokes may meet or exceed. Some of the AAR standards are previously referenced, and include the AAR S-143 Standard, SY 40AE, Y40 or YS93AE, for a 24% inch gear pocket, and for the F-type yoke, S-149 standard and the Y45 standard, the compete contents of which are herein incorporated by reference. Yokes may be constructed from ductile iron that is austempered. The ductile iron also may be used in alloy form, preferably, with nickel, molybdenum, manganese, copper, or mixtures thereof, and the ductile iron alloy austempered to form the yokes. The yokes formed from austempered ductile iron and from the preferred austempered ductile iron alloys, meet or exceed the AAR standards, and are constructed from austempered ductile iron, austempered ductile iron alloy, austempered steel, and/or austempered steel alloy, in accordance with the invention, to provide yokes that are lighter in weight than prior yokes yet possesses suitable strength, yield and elongation properties that meet or exceed AAR testing and standards requirements.

According to some embodiments, the yokes may be provided with one or more zones of reduced material, which, for example, where a casting process is used to form the yoke, may be accomplished by coring, and preferably, with specialized coring in designated zones of the yoke. Embodiments of the yoke may be provided with ribs for strengthening areas or zones of the yoke, and, according to some preferred embodiments, ribs may be provided in conjunction with coring. The ribs may be provided in configurations alternate to those preferred configurations shown and described herein. Although some embodiments of the present lightweight yoke may be constructed to resemble prior yoke geometries, including prior exterior yoke geometries, lightweight yokes according to the invention may be constructed to have geometries that are different than prior yokes but which also are compatible with coupling and usage of the prior yokes for connection with and use with prior and existing standard AAR couplers and other components of the coupling assembly. The lightweight yokes of the invention provide a lightweight alternative that may be used in place of prior yokes, wherever the prior yokes have been used or are called for.

According to preferred embodiments, the yokes may be made from a casting, although any suitable process for forming the yokes may be employed, including, for example, investment casting.

These and other advantages may be realized with the present invention. While the invention has been described with reference to specific embodiments, the description is illustrative and is not to be construed as limiting the scope of the invention. Moreover, while specific advantages have been enumerated above, various embodiments may include all, some or none of the enumerated advantages. The yokes may be formed by any suitable process, including, for example, molding, casting, and forging. The dimensions and thicknesses of the yokes, according to some preferred embodiments, are such that the yokes according to the invention, such as the yokes, 210,310,410,510,610 shown and described herein, may be used in standard coupling assemblies with other standard coupling assembly components, such as, for example, couplers, knuckles, locks and lock lifts. The improved yokes preferably may be interchangeable with prior yokes, and yokes according to the invention may meet or exceed AAR standards for yokes. Various modifications and changes may occur to those skilled in the art without departing from the spirit and scope of the invention described herein and as defined by the appended claims. It is intended that the foregoing detailed description be regarded as illustrative rather than limiting, and that it be understood that it is the following claims, including all equivalents, that are intended to define the spirit and scope of this invention.

It is intended that the foregoing detailed description be regarded as illustrative rather than limiting, and that it be understood that it is the following claims, including all equivalents, that are intended to define the spirit and scope of this invention. Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railway vehicle yoke having walls comprising top and bottom straps, and wherein the yoke is constructed from austempered ductile iron having a composition according to the following formula:

| Elements | Percentage | Range |
|---|---|---|
| C Carbon | 3.6% | +/−0.20% |
| Si Silicon | 2.5% | +/−0.20% |
| Mg Magnesium | (% S × 0.76) + 0.025% | +/−0.005% |
| Mn Manganese | | |
| Max. section > ½" | 0.35% maximum | +/−0.05% |
| Max. section < ½" | 0.60% maximum | +/−0.05% |
| Cu Cooper | 0.80% maximum | +/−0.05% |
| Ni Nickel | 2.00% maximum | +/−0.10% |
| Mo Molybdenum | 0.30% maximum | +/−0.03% |
| Sn Tin | 0.02% maximum | +/−0.003% |
| Sb Antimony | 0.002% maximum | +/−0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |

-continued

| Elements | Percentage | Range |
|---|---|---|
| Te Tellurium | 0.003% maximum | |
| Iron | Balance of formula. | |

wherein said austempered ductile iron composition further includes a post inoculant containing a mixture of La, Ca, S and O;

wherein said yoke has a minimum nodularity of 90%; a Brinell hardness of about 302 to 460; and wherein the minimum elongation in 2 inches is 2%.

2. The yoke of claim 1, wherein said austempered ductile iron has an alloy content that is greater than 4.0%.

3. The yoke of claim 2, wherein said austempered ductile iron comprises ductile iron alloyed with one or more metals selected from the group consisting of nickel, molybdenum, manganese, copper and mixtures thereof, wherein said ductile iron alloyed with said one or more metals is austempered to produce said yoke.

4. The yoke of claim 2, wherein said austempered ductile iron has a carbon equivalent (CE) value of 4.3 to 4.73.

5. The yoke of claim 1, wherein said yoke is constructed from austempered ductile iron having a carbon equivalent (CE) value of 4.3 to 4.73.

6. The yoke of claim 4, wherein said yoke is constructed from austempered ductile iron having a minimum tensile strength of between about 130 ksi and 190 ksi, and a minimum yield strength of between about 90 ksi to 160 ksi.

7. The yoke of claim 3, wherein said austempered ductile iron has a minimum tensile strength of 190 ksi, a minimum yield strength of 160 ksi, and a minimum elongation in 2 inches of 7%.

8. The yoke of claim 1, wherein said yoke walls have wall thicknesses between 0.25" to 2.5".

9. The yoke of claim 1, wherein said yoke has a minimum nodule count of 100 per mm2.

10. The yoke of claim 1, wherein said top strap and said bottom strap, have wall thicknesses between 0.375" to 1.75".

11. The yoke of claim 1, wherein said top strap and said bottom strap, have wall thicknesses between 0.6875" to 2.25".

12. The yoke of claim 1, wherein at least one wall has a maximum thickness of 0.375".

13. A railway vehicle yoke comprising:

a) a head portion at one end thereof with an opening therein;

b) a rear portion;

c) two elongated strap portions, the strap portions spanning from the head portion to the rear portion, said rear portion joining said strap portions; and d) a central pocket with two open sides formed by said two elongated strap portions;

e) wherein the yoke is constructed from austempered ductile iron having a composition according to the following formula:

| | |
|---|---|
| Carbon | 3.60-3.80% |
| Silicon | <2.60%; |
| Copper | 0.50-0.70% |
| Manganese | 0.35-0.45% |
| Nickel | <0.03% |
| Chromium | <0.05% |
| Magnesium | 0.030-0.050% |
| Iron | balance of the composition. |

f) wherein said austempered ductile iron composition further includes a post inoculant containing a mixture of La, Ca, S and O;

g) wherein said nodularity is at least 90%, and wherein said yoke has a Brinell hardness of about 302 to 460; and h) wherein the minimum elongation in 2 inches is 2%.

14. The yoke of claim 13, wherein said austempered ductile iron has an alloy content that is greater than 4.0%.

15. The yoke of claim 14, wherein said austempered ductile iron has a carbon equivalent (CE) value of 4.37 to 4.73.

16. The yoke of claim 1, wherein said yoke has internal or external ribs.

17. The yoke of claim 1, having a plurality of walls, including a rear wall, a top wall having a first end and a second end, a bottom wall having a first end and a second end, and a nose wall, wherein said nose wall joins said top wall first end and said bottom wall first end, wherein said rear wall joins said top wall second end and said bottom wall second end, wherein said walls are constructed so that the width of any wall is no greater than that defined by the measurement of a spherical dimension space having a diameter of a virtual sphere whose volume defined by the diameter fits within any portion of the wall width, wherein said virtual sphere diameter is less than or equal to about 1.25", said plurality of said walls each being constructed from said austempered ductile iron having the composition according to the said formula.

18. The yoke of claim 17, wherein said sphere diameter is less than or equal to about 1.15".

19. The yoke of claim 1, having a plurality of walls, including a rear wall, a top wall having a first end and a second end, a bottom wall having a first end and a second end, and a nose wall, wherein the width of any said wall is less than that which corresponds with a maximum spherical diameter of a virtual sphere that can fit within any said wall wherein said maximum spherical diameter of said virtual sphere is less than or equal to 1.25".

20. The yoke of claim 17, having a tail section with top and bottom surfaces, wherein the tail section is provided with dimples in the top and bottom surfaces.

21. The yoke of claim 16, wherein said internal or external ribs comprise a plurality of ribs provided in the tail section.

22. The yoke of claim 17, wherein a key slot is provided in said first end, and wherein ribs are disposed on each side of said key slot, said ribs extending beyond said key slot to said nose wall and diverging from said key slot toward an edge of said yoke.

23. The yoke of claim 1:

wherein the minimum tensile strength is 130 ksi; and wherein the minimum yield strength is 90 ksi.

24. The yoke of claim 23, wherein said austempered ductile iron comprises molten ductile iron and alloys in accordance with said formula, wherein said post inoculant is introduced to said molten ductile alloy and alloys, and wherein said yoke is a casting of austempered inoculated ductile iron.

25. A railway vehicle yoke having walls comprising top and bottom straps, and wherein the yoke is constructed from austempered ductile iron having a composition according to the following formula:

| Elements | Percentage | Range |
|---|---|---|
| C Carbon | 3.6% | +/−0.20% |
| Si Silicon | 2.5% | +/−0.20% |
| Mg Magnesium | (% S × 0.76) + 0.025% | +/−0.005% |
| Mn Manganese | | |
| Max. section > ½" | 0.35% maximum | +/−0.05% |
| Max. section < ½" | 0.60% maximum | +/−0.05% |
| Cu Cooper | 0.80% maximum | +/−0.05% |
| Ni Nickel | 2.00% max. | +/−0.10% |
| Mo Molybdenum | 0.30% max. | +/−0.03% |
| Sn Tin | 0.02% max. | +/−0.003% |
| Sb Antimony | 0.002% max. | +/−0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |
| Te Tellurium | 0.003% maximum | |
| Iron | Balance of formula. | |

wherein said austempered ductile iron composition further includes a post inoculant containing a mixture of La, Ca, S and O;

wherein said nodularity is at least 90%, and wherein said yoke has a Brinell hardness of about 302 to 460;

wherein the minimum tensile strength is 130 ksi;

wherein the minimum yield strength is 90 ksi; and wherein the minimum elongation in 2 inches is 7%.

26. The yoke of claim 23, having a plurality of walls, including a rear wall, a top wall having a first end and a second end, a bottom wall having a first end and a second end, and a nose wall, wherein said nose wall joins said top wall first end and said bottom wall first end, wherein said rear wall joins said top wall second end and said bottom wall second end, wherein said walls are constructed so that the width of any wall is no greater than that defined by the measurement of a spherical dimension space having a diameter of a virtual sphere whose volume defined by the diameter fits within any portion of the wall width, wherein said virtual sphere diameter is less than or equal to about 1.25", said plurality of said walls each being constructed from said austempered ductile iron having the composition according to the said formula.

27. The yoke of claim 13, wherein the minimum tensile strength is 130 ksi, and wherein the minimum yield strength is 90 ksi.

28. The yoke of claim 27, wherein the minimum elongation in 2 inches is 7%.

* * * * *